US005626172A

United States Patent [19]

Schumacher et al.

[11] Patent Number: 5,626,172

[45] Date of Patent: May 6, 1997

[54] TRANSFER SET

[75] Inventors: William L. Schumacher, Spring Grove; Edward G. Oilschlager, North Chicago; Thomas R. Lillegard, Crystal Lake; Arnold C. Bilstad, Deerfield; Robert E. Lewis, Lindenhurst; Sidney T. Smith, Lake Forest, all of Ill.

[73] Assignee: Clintec Nutrition Company, Deerfield, Ill.

[21] Appl. No.: 173,147

[22] Filed: Dec. 23, 1993

Related U.S. Application Data

[63] Continuation of Ser. No. 863,439, Apr. 3, 1992, abandoned.

[51] Int. Cl.[6] ..... B65B 3/00

[52] U.S. Cl. ..... 141/236; 141/104; 141/105; 141/18; 248/68.1

[58] Field of Search ..... 141/1, 2, 9, 10, 141/18, 21, 100, 102, 104, 105, 107, 98, 114, 234, 236, 311 R, 313, 346, 369, 370, 383; 222/145, 330, 331; 138/112, 118.1, 120, 106, 111; 604/34, 153, 250; 248/68.1; 285/137.1, 369, 417, 921, 188; 403/6, 350, 375; 417/319, 426, 474–477; 128/DIG. 12; 174/72 A, 97

[56] References Cited

U.S. PATENT DOCUMENTS

| | | | |
|---|---|---|---|
| 144,135 | 10/1873 | Pritchard | 174/97 X |
| 1,132,676 | 3/1915 | Murray et al. | 174/97 X |
| 2,978,840 | 4/1961 | Tatsch | 138/106 |
| 3,502,034 | 3/1970 | Pickup | 417/477 |
| 3,565,286 | 2/1971 | Latham, Jr. . | |
| 3,940,019 | 2/1976 | Kross et al. . | |
| 4,236,880 | 12/1980 | Archibald | 604/153 X |
| 4,467,844 | 8/1984 | DiGianfilippo et al. | 141/1 |
| 4,512,764 | 4/1985 | Wunsch | 604/80 |
| 4,513,796 | 4/1985 | Miller et al. | 141/83 |
| 4,789,014 | 12/1988 | DiGianfilippo et al. | 141/83 |
| 4,816,617 | 3/1989 | Valosen | 174/97 X |
| 4,832,382 | 5/1989 | Kapgan | 285/369 |
| 4,886,431 | 12/1989 | Soderquist et al. | 417/477 |
| 4,899,964 | 2/1990 | Sick | 248/68.1 |
| 5,029,621 | 7/1991 | Lewis | 141/1 |
| 5,043,746 | 8/1991 | Abe | 248/68.1 X |
| 5,076,332 | 12/1991 | Lewis et al. | 141/83 |
| 5,165,874 | 11/1992 | Sancoff et al. | 417/474 |

FOREIGN PATENT DOCUMENTS

| | | | |
|---|---|---|---|
| 2453296 | 5/1976 | Germany | 604/153 |

OTHER PUBLICATIONS

IBM Technical Disclosure Bulletin, Multiple Pneumatic Coupling, E.F. Helinki, vol. 11, No. 10, Mar. 1969.

*Primary Examiner*—J. Casimer Jacyna
*Attorney, Agent, or Firm*—Hill, Steadman & Simpson

[57] ABSTRACT

The present invention provides an improved transfer set for use in an automated compounding device. The transfer set comprises a plurality of fluid conduits, each fluid conduit including a first section and a second section, the first and second sections being coupled together in fluid communication by a coupler. A housing is provided for receiving at least a portion of the fluid conduits and the coupler. The housing defines separate channels for receiving a portion of the second section of each fluid conduit. The channels extend for a sufficient distance so that at least substantially an entire length of the second section that is located in the housing is located in a channel thereby securing the fluid conduits in place in the housing. An improved method for making a transfer set is also provided.

23 Claims, 4 Drawing Sheets

TRANSFER SET

This is a continuation, of application Ser. No. 07/863,439 filed Apr. 13, 1992, now abandoned.

BACKGROUND OF THE INVENTION

The present invention relates generally to devices for accurately transferring multiple, individual fluids from multiple source containers into a single receiving container. More specifically, the present invention relates to a transfer set for use in such devices.

U.S. Pat. No. 4,789,014 discloses an automated system for adding multiple fluids to a single container. The device as described accurately transfers multiple individual fluids from multiple source containers into a single receiving container. Fluid flows from the multiple source containers through individual fluid conduits to a chamber having a single fluid outlet conduit. The fluid outlet conduit is in fluid communication with a single receiving container. A pressure conduit is in communication with the chamber for alternately creating positive and negative pressures in the chamber to cause fluid to flow from the individual source containers into the chamber, and to cause fluid to flow from the chamber into the receiving container in response to commands from a controller.

In hospitals, it is frequently necessary to provide solutions for intravenous administration to a patient which contain a variety of drugs in a single solution container. For example, such a need arises when a patient is receiving all of his nutritional needs intravenously. In this situation, the patient will typically receive a basic solution containing amino acids, dextrose, and fat emulsions which provide a major portion of the patient's nutritional needs. However, this solution is insufficient to maintain a patient for an extended period of time.

Therefore, a typical total parenteral nutrition solution includes as many as eight to twelve additional additives. The additives are typically minute quantities of vitamins, minerals, electrolytes, etc.

One way to prepare the necessary solutions for total parenteral nutrition is for the pharmacist to individually add each of the additional additives to a solution container after the base solution has been prepared. This is typically done with individual syringes and requires a relatively long time on the part of the pharmacist to accurately add each of the required additives.

Automated compounding devices have been developed to assist the pharmacist in preparing solutions for total parenteral nutrition. An example of such a device is described in U.S. Pat. Nos. 4,467,844 and 4,513,796. This device is used to assist the pharmacist in automatically compounding base solutions of amino acids, dextrose, and fat emulsion. The system typically uses three or more peristaltic pumps to individually pump each of the base solutions from three or more separate source containers. Computer software has been developed and is used to program the amount of solution required for a series of individual patients.

Examples of automated compounding machines include the Automix® and Micromix® compounders distributed by Clintec Nutrition Company.

With respect to the Micromix® compounder, disclosed in U.S. Pat. No. 4,789,014, the device includes a transfer set. The transfer set is used to transfer fluids from each of the individual containers to a receiving container. The transfer set includes a tray in which the fluid conduits are located. The fluid conduits are designed to be connected to specific containers containing specific fluids.

Although the current transfer set functions satisfactorily in the Micromix® compounder, to insure that there is no operator or manufacturing error, rigorous QC and other testing is performed. For example, in a typical Micromix® compounder transfer set, ten separate fluid conduits are positioned in the tray. Although these fluid conduits, when manufactured and packaged, are typically arranged so that they can be easily coupled to the specific containers and positioned in the Micromix® compounder, if a manufacturing problem were to occur and a fluid flow path is crossed, this could result in a fluid conduit being coupled to the wrong container, and an incorrect solution being created if not discovered by the operator. Therefore, extensive testing is performed at the factory to insure any such mistakes are caught at the factory.

Additionally, the transfer set is designed to be located so as to allow a first occlusion means to selectively prevent fluid flow from each of the individual fluid conduits to a chamber. If the transfer set is not properly located in the first occlusion means, the system will not function. To locate the transfer set in proper position with respect to the first occluder, holes are located at an end of the tray. The holes are then aligned in the occluder to insure that the transfer set is properly positioned therein.

In the current transfer set used in the Micromix® compounder, the holes are created in the transfer set in a secondary stamping or punching operation. Alignment problems can occur if the holes created during secondary operation are not properly located and are out of machine tolerances; this will prevent the occluder from working.

Heretofore, typically the transfer sets, when created, are sealed around the fluid conduits during the manufacturing process. After the manufacturing process, the fluid conduits are checked for leaks or other problems. If a problem is discovered in an individual fluid conduit, because the transfer set is sealed, it is not possible to remedy the problem. Instead, the transfer set and enclosed fluid conduits must be scrapped. This results in a not insubstantial loss.

SUMMARY OF THE INVENTION

The present invention provides an improved transfer set for use in an automated compounding device, such as the Micromix® compounder available from Clintec Nutrition Company, Deerfield, Ill. The transfer set overcomes disadvantages of prior devices including: preventing the occlusion placement members from being out of position; preventing the fluid conduits from becoming misaligned; and providing a transfer set that will allow fluid conduits to be replaced after the testing of same should a defective fluid conduit be found.

To this end, the present invention provides a transfer set comprising a plurality of fluid conduits, each fluid conduit including a first section and a second section, the first and second sections being coupled together in fluid communication by a coupler. A housing is provided for receiving at least a portion of the fluid conduits and the coupler. The housing defines separate channels for receiving a portion of the second section of each fluid conduit. The channels extend for a sufficient distance so that the second section of the fluid conduit is secured in place in the housing.

In an embodiment, the present invention provides a tray for use in a transfer set comprising a first housing section and a second housing section, the first and second housing sections defining a plurality of elongated channels. The channels are designed to receive and position fluid conduits within the tray.

In an embodiment, the housing includes locking flanges that extend over a portion of each channel to secure the fluid conduits within the channels.

In an embodiment, the housing defines a gate member defining a plurality of truncated channels. The truncated channels separately receive a portion of a compliant section of each fluid conduit. In a further embodiment, the housing defines two spaced apart gate members, each defining a plurality of truncated channels, for separately receiving different portions of the compliant section of each fluid conduit.

In an embodiment, the first and second housings include means for removably securing the housings together.

In an embodiment, the first and second housings are designed to be welded together.

In an embodiment, the first and second housings are created by a thermoforming process.

In an embodiment, the first and second housings defines an occluder location means on a bottom portion of the transfer set.

The present invention also provides a method for constructing a transfer set comprising the steps of: forming a first and second section of a housing to create a tray to receive a plurality of fluid conduits by a thermoforming process, a first occluder locator aperture being formed in the first and second housing during the primary operation as the first and second trays are formed.

After the first and second housings are formed, the fluid conduits are positioned in channels located in the first housing. The second housing is then removably secured to the first housing. The fluid conduits are then tested and if necessary, defective fluid conduits are replaced. After the necessary fluid conduits have been replaced, the first and second housings are welded together.

An advantage of the present invention is that an enhanced reliable method is provided to insure that users are delivered solutions or additives as specified.

A further advantage of the present invention is that malfunctions due to machine interface are minimized.

Moreover, an advantage of the present invention is that the potential for crossed fluid conduits is eliminated.

Still further, an advantage of the present invention is ease of manufacturability.

Furthermore, an advantage of the present invention is the elimination of additional inspectors on the assembly line to inspect for tray/fluid conduit defects.

Additionally, an advantage of the present invention is that it reduces the scrap rate.

Further, an advantage of the present invention is that the profile of the tube exit from the tray eliminates kinked tubing.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a transfer set having a plurality of fluid conduits. The transfer set is constructed specifically for use in a compounding device, such as the Micromix® compounder available from Clintec Nutrition Company. However, the transfer set can be used in other compounding devices.

Figure 1:
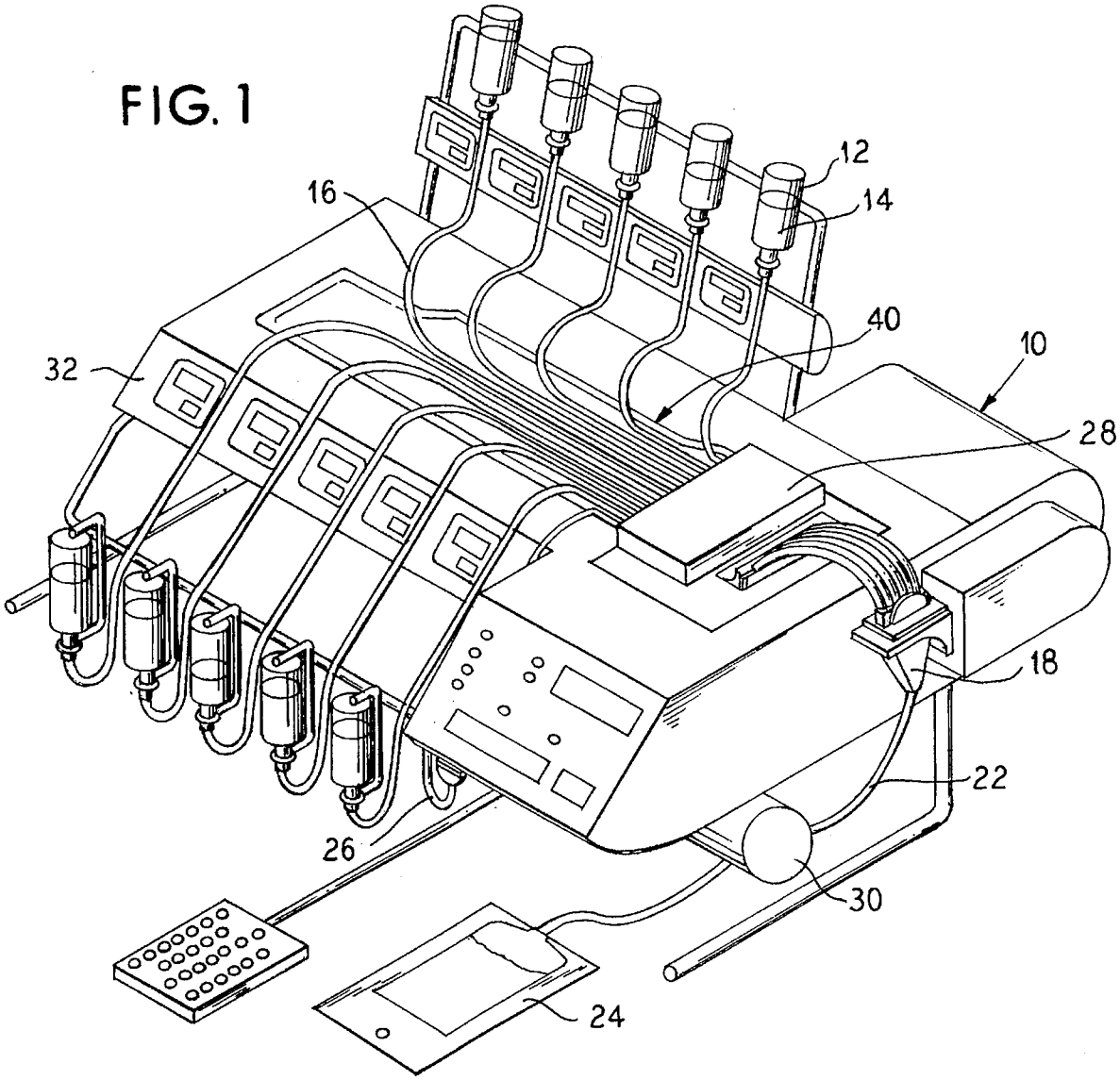
FIG. 1 illustrates a perspective view of a compounding device including the transfer set of the present invention.

The illustrated embodiment of the transfer device is designed for use in a compounder such as that set forth in U.S. Pat. No. 4,789,014 entitled: "AUTOMATED SYSTEM FOR ADDING MULTIPLE FLUIDS TO A SINGLE CONTAINER," the disclosure of which is incorporated herein by reference. FIG. 1 illustrates the compounder 10. A detailed description of the compounder 10 is set forth in U.S. Pat. No. 4,789,014.

Briefly, the compounder 10 provides a device for accurately transferring multiple individual fluids 14 from multiple source containers 12 into a single receiving container 24. In the compounder 10, fluid flows from the multiple source containers 12 through individual fluid inlet conduits 16 into a measuring chamber 18 having a single fluid outlet conduit 22 in fluid communication with the single receiving container 24. The chamber 18 also has a pressure conduit 26.

A first occlusion means 28 for selectively preventing fluid flow from each of the individual fluid inlet conduits 16 to the chamber 18 is provided. A pressure means or differential pressure source for selectively creating positive and negative pressures in the chamber 18 to control the rate of fluid flow through the chamber 18 is also provided. In order to control fluid flow from the chamber 18 to the receiving container 24, a second occlusion means 30 for selectively occluding fluid flow from the chamber 18 through outlet fluid conduit 22 to the receiving container 24 is provided.

Control means 32 for controlling the first and second occlusion means 28 and 30, respectively, and the pressure means is provided to perform various functions. For example, the control means 32 causes the first occlusion means 28 to allow fluid to flow through at least one of the individual fluid conduits 16 while causing the second occlusion means 30 to prevent fluid flow into the receiving container 24.

The control means 32 also simultaneously causes the pressure means to create a negative pressure in the chamber 18 to precisely control the amount and rate of fluid flow into the chamber. The control means 32 further causes the first occlusion means 28 to prevent fluid flow through all of the individual fluid conduits 16 after a predetermined amount of fluid has been delivered to the chamber 18. The control means 32 then further causes the second occlusion means 30 to allow fluid to flow from the receiving chamber 18 through the outlet fluid conduit 22 while simultaneously causing the pressure means to create a positive pressure in the chamber to force fluid from the chamber into the receiving container 24.

As illustrated in FIG. 1, the transfer set 40 of the present invention is designed to be located in the device. The transfer set 40 is specifically illustrated in FIG. 2. The purpose of the transfer set 40 is to transfer fluids 14 from individual containers 12 into a receiving chamber 18.

As illustrated, the transfer set 40 includes a plurality of individual fluid conduits 16*a–j*. Fluid conduit 26 serves a different purpose than fluid conduits 16*a–j* and will be discussed separately infra. Each individual fluid conduit 16*a–j* is formed of a flexible piece of tubing. Various materials can be used to make the flexible tubing 16*a–j* such as polyvinyl chloride (PVC) or polyethylene tubing. Polyethylene tubing may be desired when a transfer set 40 is used with drugs that are incompatible with PVC.

A proximal end 17*a–j*, respectively, of each of the individual fluid conduits 16*a–j* is mounted in a tray 42. The purpose of the tray 42 is to maintain each fluid conduit 16*a–j* in a spaced apart relationship from the other conduits and to keep the conduits organized when the transfer set 40 is stored and is mounted onto the device 10. Preferably, the tray 42 is thermoformed plastic made of polyvinyl chloride (PVC) or glycol-modified polyethylene terephthalate (PETG). However, other materials and methods can be used to make the tray 42.

In the preferred embodiment of the tray 42 illustrated, the tray 42 is specifically designed so that when it is positioned on the device 10, a distal end 46 of each fluid conduit is positioned adjacent to the particular fluid source container to which the distal end of the conduit is to be connected.

Figure 2:
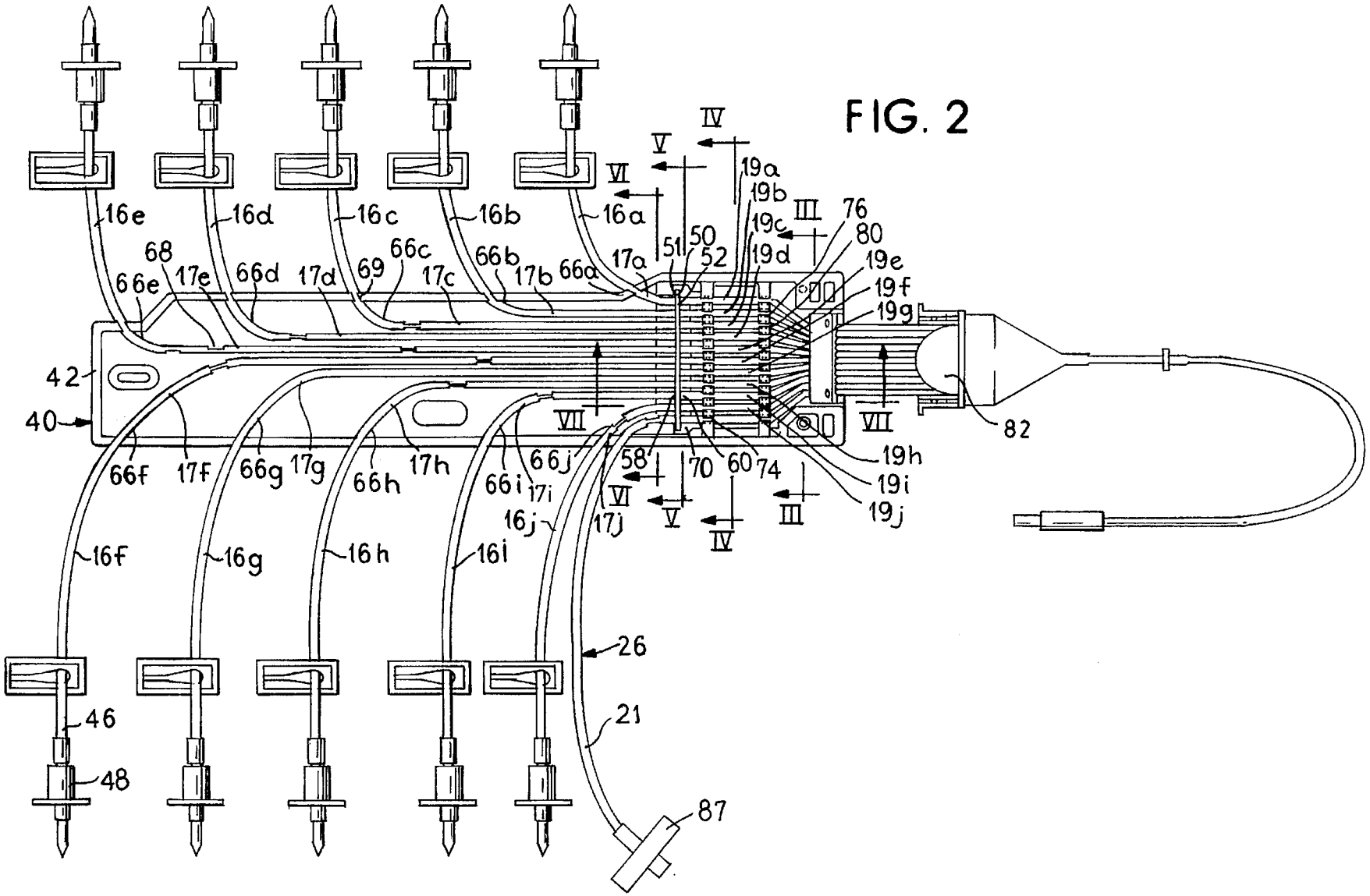
FIG. 2 illustrates a perspective view of an embodiment of the transfer set prior to being positioned in the compounding device.

As illustrated in FIGS. 1 and 2, the individual conduits 16*a–j* exit the tray 42 in such a manner that half of the individual conduits 16*a–e* are directed to one side of the device 10, while the other half of the conduits 16*f–j* are directed downwardly to the other side of the device. Since the source containers 12 in the preferred embodiment illustrated, are disposed along both sides of the device 10, this greatly assists the pharmacist in insuring that the appropriate individual conduit 16*a–j* is connected to its respective source container 12 when the transfer set 40 is placed on the device 10.

In an embodiment of the invention, each of the individual conduits 16*a–j* may be color-coded with a stripe or other type of coding on the tubing to identify the particular tube. In the embodiment illustrated, each conduit includes a vented spike 48 at the distal end 46. The spike 48 is used to provide fluid communication between the distal end 46 of the conduit 16*a–j* and the individual source container 12.

The purpose of a vented spike 48 is to allow air to be vented into the source container 12 as the fluid is being dispensed from the source container when the source container is a rigid, non-vented vial or bottle. If a flexible container is used as a source container 12, or if the vials are vented vials, it is not necessary to provide venting in the spike.

In the embodiment illustrated in FIG. 2, a coupler 50 is provided. The proximal end 17*a–j* of each fluid conduit 16*a–j* is attached to one side 51 of the coupler 50. Individual tubes 19*a–j* which are highly compliant are attached to the other side 52 of the coupler 50.

The coupler 50 includes a wall 56 which contains a first series of coupling conduits 58 extending from one side 51 thereof and a second series of coupling conduits 60 extending from the other side 52 of the wall 56. Each of the first and second coupling conduits 58 and 60 in the series is in fluid communication with one another. Accordingly, when the end of one of the conduits 16*a–j* is fixed in fluid communication with one of the first series of coupling conduits 58, and an end of one of the highly compliant individual tubes 19*a–j* is attached to one of the second series of conduits 60, fluid communication is produced between the conduit 16*a–j* and its respective highly compliant individual tube 19*a–j*.

While other methods of producing fluid communication between the conduits 16*a–j* and highly compliant tubes 19*a–j* may be used in accordance with the invention, the coupler 50 represents one system for attaching the two portions of the tubing to one another while maintaining the tubes in a highly organized manner.

Pursuant to the present invention, the tray 42 provides means for insuring that the proximal ends 17*a–j* of conduits 16*a–j* are securely positioned in place. To this end, as illustrated in FIGS. 2, 6, and 7, a bottom half 67 of the tray 42 defines a series of channels 66*a–j* extending for substantially an entire distance of a bottom half 67 of the tray 42.

The channels 66*a–j* are designed so that each separately receives a proximal end portion 17*a–j* of the fluid conduits 16*a–j*. Because the channels 66*a–j* extend for substantially the entire length of the tray 42 in which the proximal end 17*a–j* of the fluid conduits 16*a–j* are located, each of the fluid conduits is maintained in a spaced apart position.

Figure 6:
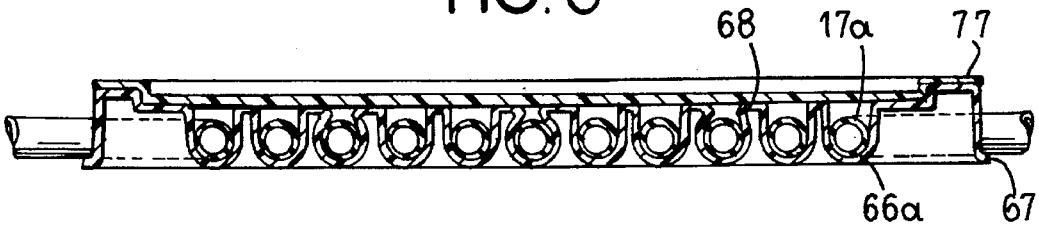
FIG. 6 illustrates a cross-sectional view of the transfer set of FIG. 2 taken along lines VI—VI of FIG. 2.
Figure 7:
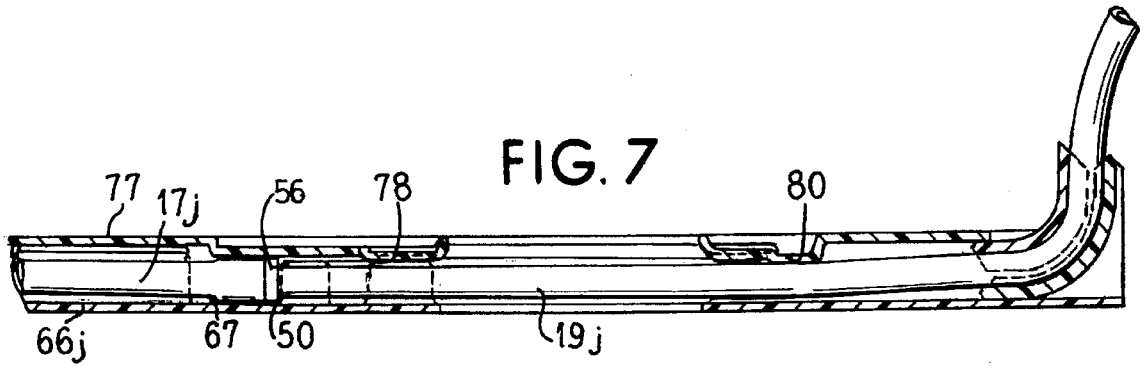
FIG. 7 illustrates a cross-sectional view of the transfer set of FIG. 2 taken along lines VII—VII of FIG. 2.

As illustrated in FIG. 6, to insure that the conduits 16*a–j* remain positioned within the channels 66*a–j*, locking flanges 68 are provided. The fluid conduits 16*a–j* are snapped into the channels 66*a–j* over the locking flanges 68. The locking flanges 68 prevent the fluid conduits 16*a–j* from exiting the channels 66*a–j* and becoming dislodged therefrom. In the preferred embodiment illustrated, the exit 69 has a profile, that can define locking flanges 68, that prevents kinking of the fluid conduits 16*a–j*.

Figure 5:
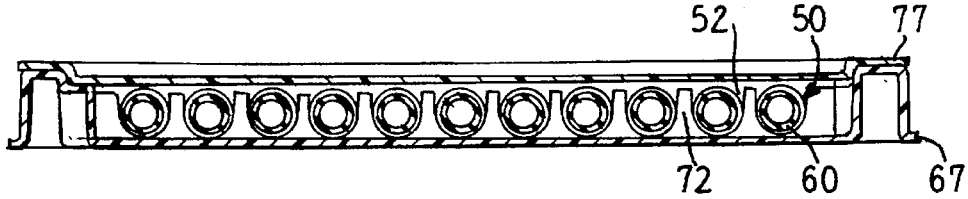
FIG. 5 illustrates a cross-sectional view of the transfer set of FIG. 2 taken along lines V—V of FIG. 2.

As illustrated in FIGS. 2 and 5, the tray 42 also defines a coupler channel 70, oriented in a substantially perpendicular manner to the fluid conduit channels 66*a–j* for receiving the coupler 50. The coupler channel 70 insures that the coupler 50 is properly positioned and secured within the tray 42.

Located with the coupler channel 70 is a gate 72 for receiving the second series of coupling conduits 60. The gate 72 assists in insuring that the coupler 50 is securely positioned within the tray 42.

Figure 4:
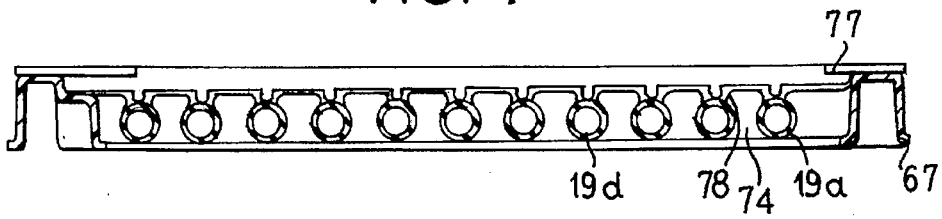
FIG. 4 illustrates a cross-sectional view of the transfer set of FIG. 2 taken along lines IV—IV of FIG. 2.

As also illustrated in FIG. 2, in the preferred embodiment illustrated, the tray 42 also includes two spaced apart second and third gate members, or truncated sets of channels, 74 and 76 for receiving portions of the compliant tubes 19*a–j*. FIG. 4 illustrates the second gate member 74.

The second and third gate members 74 and 76 are formed in a bottom half 67 of the tray 42. The top half 77 of the tray 42 includes downwardly projecting flanges 78 and 80, respectively, that urge, when the bottom and top halves of the trays 42 are coupled together, portions of the compliant tubes 19*a–j* down into the second and third gates 74 and 76. The downwardly projecting flanges 78 and 80 insure that the compliant tubes 19*a–j* remain properly positioned within the tray 42.

As illustrated in FIG. 2, one end of the individual compliant tubes 19*a–j* is connected to a manifold 82 in the upper portion of a chamber 18. The manifold 82 includes a series of connector conduits (not shown) to which one end of each of the individual compliant tubes 19*a–j* can be attached to provide fluid communication between the individual fluid tubes and the chamber when the manifold 82 is connected to the chamber.

The manifold 82 has individual, spaced apart, drop former structures (not illustrated) for each line for discouraging accumulation of droplets on the manifold. This prevents possible mixing of the incompatible solutions due to droplets hanging on the manifold 82. This also prevents measuring the liquid of materials that were not actually transferred into the container 24.

As discussed above, a pressure means (not shown) is provided for selectively creating positive and negative pressures in the chamber 18 to control the rate of fluid flow through the chamber. The pressure means is in fluid communication with a pressure conduit. The pressure conduit 26 is simply a conduit line 21 of the transfer set 40 as illustrated in FIG. 2. This conduit line 21, unlike the other individual conduit lines 16*a–j* is not connected to an individual source container. Instead, the conduit line 21 is provided with a filter means 87 for filtering air entering the conduit line 21 and is connected to a pump.

As illustrated, the tray 42 defines a channel for receiving the conduit 21. Likewise, the second and third gate member 74 and 76 receive portions of a compliant tube portion of the conduit line 21.

Figure 8:
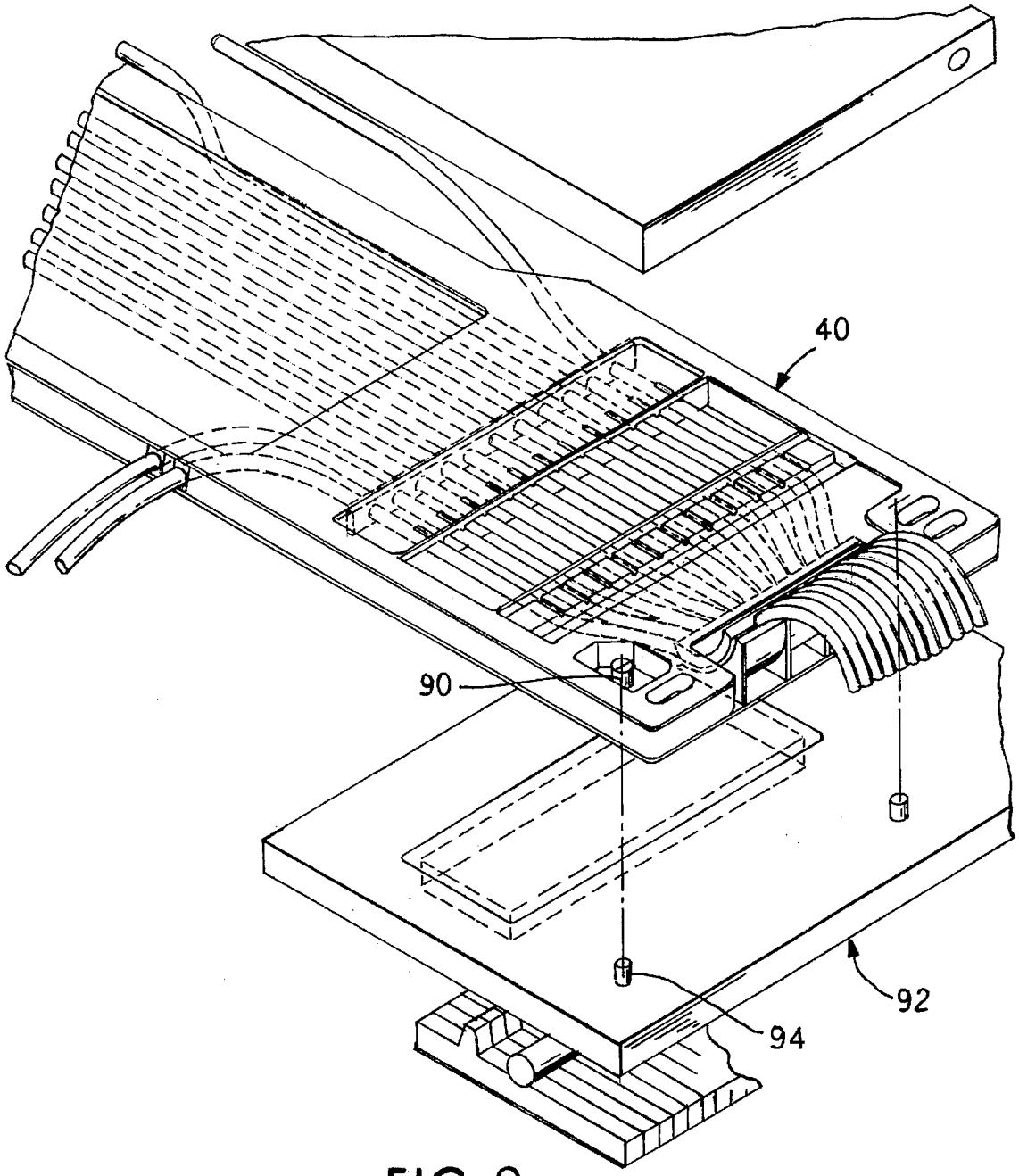
FIG. 8 illustrates an exploded perspective view of the transfer set and a portion of the first occlusion means of the compounding device.

Pursuant to the present invention, the top and bottom halves 77 and 67, respectively, of the tray member 42 are thermoformed in a one-step process. Contrary to prior practices, an occluder locator aperture 90 is formed when the tray 42 is formed in the primary process. As illustrated in FIG. 8, the occluder locator aperture 90 allows the tray member 42 to be correctly positioned in an occluder 92 and specifically, on pin 94. The locator aperture 90 assures that the transfer set is correctly positioned, and thereby the tubings 16*a–j* correctly aligned, in the first occluder means. The cooperation of the occluder 92 and transfer set 40 is discussed in U.S. Pat. No. 4,789,014.

Because the locator aperture 90 is created in a primary operation, rather than in the secondary operation as in the prior art, one is assured that the locator aperture 90 is in the proper position.

Figure 3:
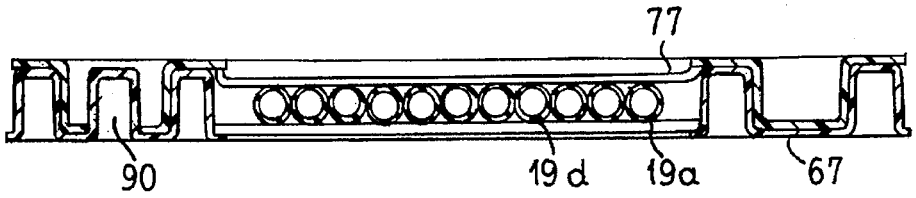
FIG. 3 illustrates a cross-sectional view of the transfer set of FIG. 2 taken along lines III—III of FIG. 2.

The tray 42, pursuant to the present invention, is also created as two separate halves, a top and bottom section 77 and 67 that are designed to be, at least initially, removably secured together. To this end, as illustrated in FIGS. 2 and 3, portions of the top and bottom halves 77 and 67, respectively, are designed to be interfitted to allow the tray to be removably snapped together.

Because the top and bottom halves 77 and 67 can be removably secured together, this allows the fluid conduits 16*a–j* to be positioned in the tray 42 and the transfer set 40 constructed. The transfer set 40 can be tested to insure that none of the fluid conduits 16*a–j* are defective. If a fluid conduit is found to be defective, in contrast to the prior art, the top and bottom halves 77 and 67 can be separated and the defective fluid conduit 16*a–j* replaced.

If desired, the tray can comprise a one-piece hinged structure wherein the top and bottom halves are hinged together.

Preferably, after testing, the top and bottom halves 77 and 67 are welded together. However, other means for permanently securing the halves together, e.g., curable adhesives, can be used.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A transfer set comprising:

a plurality of fluid conduits, each of the fluid conduits including a first section of substantially equal lengths and a second section, the first and second sections coupled together in fluid communication with a coupler; and a housing for receiving at least a portion of the plurality of fluid conduits and the coupler, the housing defining a plurality of separate channels for receiving a portion of the second section of each of the plurality of fluid conduits wherein the portions of the second sections within the housing have different lengths, each of the plurality of channels extending for at least substantially an entire distance that the second sections are located in the housing thereby securing the second sections in place in the housing wherein each of the plurality of channels is continuous, equally sized and non-linear and further wherein the housing comprises a first section and a second section removably secured together.

2. The transfer set of claim 1 wherein the housing includes locking flanges extending over a portion of at least one of the plurality of channels to secure the second section of each of the plurality of fluid conduits within the channel.

3. The transfer set of claim 1 wherein the housing defines a coupler channel for receiving the coupler.

4. The transfer set of claim 1 wherein the coupler includes a plurality of tube connectors for securing the first section and the second section of the fluid conduits to the coupler, each tube connector including a first tube and a second tube, extending from opposite sides of the coupler and defining channels in fluid communication with each other, the housing defining gate members for receiving the first tubes and thereby limiting movement of the coupler.

5. The transfer set of claim 1 wherein the housing defines a gate member defining a plurality of truncated channels for separately receiving a portion of the first section of each fluid conduit.

6. The transfer set of claim 5 wherein the housing includes means for urging the first section of each fluid conduit downwardly into the truncated channel.

7. The transfer set of claim 1 wherein the housing defines two spaced apart gate members, each gate member defining a plurality of truncated channels for separately receiving different portions of the first section of each fluid conduit.

8. The transfer set of claim 7 wherein the housing includes means for urging the first section of each fluid conduit downwardly into each of the truncated channels defined by the two spaced apart gate members.

9. The transfer set of claim 1 wherein the housing comprises a first section and a second section that are welded together.

10. A tray for use in a transfer set, the tray comprising:

a plurality of fluid conduits; and a first housing section and a second housing section, the first and second housing sections, when mated, defining a plurality of integrally formed, continuous, equally sized and non-linear channels for receiving portions of the plurality of fluid conduits extending from a position located near a first end of the housing sections and extending for a distance either to a second end or a side of the housing sections wherein at least one of the plurality of channels extends for a greater distance within the housing sections than another one of the plurality of channels, each of the plurality fluid conduits extending in each of the plurality of channels between the first housing section and the second housing section.

11. The tray of claim 10 wherein the first housing section defines the plurality of channels.

12. The tray of claim 10 wherein the first housing section includes locking flanges extending over a portion of the plurality of channels.

13. The tray of claim 10 wherein the first housing section includes a gate member for separately receiving a portion of the plurality of conduits, the gate member constructed and arranged between the first end and the second end of the housing sections.

14. The tray of claim 10 wherein the first housing section includes two spaced apart gate members for separately receiving different portions of the plurality of fluid conduits, the two spaced apart gate members constructed and arranged between the first end and the second end of the housing sections.

15. The tray of claim 10, wherein the first and second housing sections include means for removably securing the housing sections together.

16. The tray of claim 10 wherein the first housing and the second housing sections are designed to be welded together.

17. The tray of claim 10 wherein the first housing section and the second housing section are created by a thermoforming process.

18. The tray of claim 10 wherein the first housing section includes an occluder locator aperture on a bottom thereof.

19. A transfer set for use in a device for accurately transferring multiple individual fluids from multiple source containers to a single receiving container, in which fluid flows from said multiple source containers through individual fluid conduits to a chamber having a chamber outlet conduit in fluid communication with the single receiving container, the device including a first occlusion means for selectively preventing fluid flow from each of said individual fluid conduits to said chamber, the transfer set comprising:

a plurality of fluid conduits, each fluid conduit including a first section and a second section, the first section and the second section coupled together in fluid communication with a coupler; and a housing for receiving at least a portion of the plurality of fluid conduits and the coupler, the housing defining a plurality of separate, continuous, non-linear and equally sized channels for receiving a portion of the second section of each of the plurality of fluid conduits wherein at least one channel extends for a greater distance within the housing than another channel, each of the plurality of channels extending for at least substantially an entire distance that the second sections are located in the housing thereby securing the second sections in place in the housing wherein the housing defines a first occlusion means locator aperture for insuring that the transfer set is properly positioned in the first occlusion means and further wherein the housing comprises a first unit and a second unit including means for removably securing the units together.

20. The transfer set of claim 19 wherein the housing includes locking flanges extending over a portion of the plurality of channels to secure the second section of each of the plurality of fluid conduits within the channels.

21. The transfer set of claim 19 wherein the housing defines a coupler channel for receiving the coupler.

22. The transfer set of claim 19 wherein the coupler includes a plurality of tube connectors for securing the first section and the second section of the fluid conduits to the coupler, each tube connector including a first tube and a second tube, extending from opposite sides of the coupler and defining channels in fluid communication with each other, the housing defining gate members for receiving the first tubes and thereby limiting movement of the coupler.

23. The transfer set of claim 19 wherein the housing defines a gate member defining a plurality of truncated channels for separately receiving a portion of the first section of each fluid conduit.

* * * * *